US009929510B2

(12) United States Patent
Vass

(10) Patent No.: US 9,929,510 B2
(45) Date of Patent: Mar. 27, 2018

(54) LOCKING POWER CONNECTOR APPARATUS

(71) Applicant: Burland Technology Solutions Limited, Great Blakenham (GB)

(72) Inventor: Richard Anthony Vass, Gedding (GB)

( * ) Notice: Subject to any disclaimer, the term of this patent is extended or adjusted under 35 U.S.C. 154(b) by 0 days.

(21) Appl. No.: 15/299,147

(22) Filed: Oct. 20, 2016

(65) Prior Publication Data

US 2017/0133791 A1 May 11, 2017

(30) Foreign Application Priority Data

Nov. 11, 2015 (GB) ..... 1519866.6

(51) Int. Cl.

| | |
|---|---|
| ***H01R 4/50*** | (2006.01) |
| ***H01R 13/625*** | (2006.01) |
| ***H01R 13/639*** | (2006.01) |
| ***H01R 13/652*** | (2006.01) |
| ***H01R 13/74*** | (2006.01) |
| ***H01R 24/78*** | (2011.01) |
| ***H01R 13/20*** | (2006.01) |
| *H01R 103/00* | (2006.01) |

(52) U.S. Cl.

CPC ..... *H01R 13/6395* (2013.01); *H01R 13/20* (2013.01); *H01R 13/652* (2013.01); *H01R 13/748* (2013.01); *H01R 24/78* (2013.01); *H01R 13/639* (2013.01); *H01R 2103/00* (2013.01)

(58) Field of Classification Search

CPC .. H01R 13/20; H01R 13/639; H01R 13/6395; H01R 13/652; H01R 13/748

USPC ..... 439/346, 106

See application file for complete search history.

(56) References Cited

U.S. PATENT DOCUMENTS

| | | | | |
|---|---|---|---|---|
| 4,846,707 | A | 7/1989 | Pirkle | |
| 8,439,697 | B2 * | 5/2013 | Vass | H01R 13/6395 439/270 |
| 8,668,512 | B2 * | 3/2014 | Chang | H01R 13/633 439/304 |
| 8,714,995 | B2 * | 5/2014 | Chang | H01R 13/6395 439/345 |
| 8,840,417 | B2 * | 9/2014 | Chang | H01R 13/6395 439/345 |

(Continued)

FOREIGN PATENT DOCUMENTS

| | | |
|---|---|---|
| GB | 2383202 A | 6/2003 |
| GB | 2463468 A | 3/2010 |

*Primary Examiner* — Hae Moon Hyeon

(74) *Attorney, Agent, or Firm* — Michael F. Krieger; Kirton McConkie

(57) ABSTRACT

A locking socket 101 for making an electrical connection with an electrical plug has a socket connection portion with a pivoting latch plate type power pin locking mechanism 112, 114 having an aperture with edges for gripping an power pin when inserted. The latch plate 114 is biased away from a release orientation to a locking orientation. A release mechanism comprises a manual button engaged with a slide piece 128 which slides along a first direction 158 to pivot the latch plate from a locking orientation to a release orientation to release the inserted power pin. At least one resiliently flexible arm 152 extends laterally from a main body of the slide piece. The arm is progressively flexed by movement of the main body when the button is pressed, causing the arm to provide a biasing force that urges the slide piece in the opposite direction 159.

20 Claims, 5 Drawing Sheets

(56) References Cited

U.S. PATENT DOCUMENTS

| | | | | |
|---|---|---|---|---|
| 8,968,015 | B2 * | 3/2015 | Chang | H01R 13/639 439/135 |
| 2008/0076291 | A1 | 3/2008 | Ewing et al. | |
| 2011/0237108 | A1 * | 9/2011 | Vass | H01R 13/6395 439/345 |
| 2013/0157495 | A1 | 6/2013 | Chang | |

* cited by examiner

LOCKING POWER CONNECTOR APPARATUS

CROSS-REFERENCE TO RELATED APPLICATIONS

This application claims priority to United Kingdom Patent Application No. 1519866.6 filed on Nov. 11, 2015 titled Locking Power Connector Apparatus.

BACKGROUND a. Field of the Invention

The present invention relates to the field of electrical power connectors, and in particular power connectors that are used to connect a source of mains power to an item of electrical equipment.

b. Related Art

Items of electrical equipment used in the home or in an office environment may be connected to the mains supply by means of a power cable that has one end plugged into a mains wall socket. Instead of being permanently wired, the other end of the cable may terminate with a line socket that can be plugged into a matching plug. When the plug is provided on the chassis of the equipment, this is called a chassis plug or a panel plug.

An alternative arrangement is one in which a line plug having projecting power pins is plugged into a matching socket. When the socket is provided on the chassis of the equipment, this is called a chassis socket or a panel socket. The socket may be surrounded by a channel for receiving a protective skirt of the line plug.

The most common examples of such power connectors are those that adhere to the standards defined by the International Electrotechnical Commission (IEC) specification IEC 60320, particularly the C13 and C14 connectors used with personal computer equipment and peripherals.

Some types of power connector are also available as line plug and panel socket versions, but these are less common. In the IEC specification, the term "connector" refers to line sockets (or panel sockets) and the term "inlet" refers to panel plugs (or line plugs).

The IEC standard includes two and three-conductor plugs of various current capacities and temperature ratings, all designed specifically for the purpose of attaching a mains power cord to a piece of electrical equipment. One of the main advantages of the IEC connector standard is that this allows for an interchangeable mains power cord, making it very easy for equipment manufacturers to sell their equipment anywhere in the world as long as their equipment can operate on both 120/240 volt, 50/60 Hz mains power systems.

One disadvantage of such connectors and inlets is that the joined connector and inlet can readily be pulled apart, which can happen when equipment is moved about or when a force is applied to the connecting cable resulting in an unexpected loss of power to equipment that is in use.

U.S. Pat. No. 4,846,707 describes a safety device which resists removal of a plug once properly inserted into a socket. This is achieved by providing, in the outlet, an actuating arm that must be manually moved to permit a plug to be removed from the socket. The actuating arm is biased by a heavy spring and acts on contacts which grip the plug.

US 2008/0076291 describes an electrical plug retainer for holding a plug in engagement with a hardware interface. The retainer includes a clamping mechanism for gripping the cord of the plug and arms for connecting to the hardware interface. Preferably, ends of the arms are inserted in apertures present in the sides of the hardware interface.

Patent document GB 2383202 A therefore proposes that a line socket has a front connector portion with forwards facing power pin receptacles. The inside of one of the power pin receptacles has a pivoting latch plate that has an aperture for receiving a power pin of a plug, the aperture having edges that allow a power pin to enter the receptacle but which dig in to the power pin when this is pulled in the opposite direction. The power pin, and hence the rest of the panel plug, are therefore locked to the line socket. Patent document GB 2463468 A uses the same type of pivoting latch plate, but in a locking panel socket in which a socket connection portion is separated from a panel portion by an intervening channel for receiving a protective skirt or shroud of a line plug.

The slide piece has a slide shaft that slides longitudinally in a guide inside the line socket or the panel socket and has a slot that faces substantially transversely away from an end portion of the slide piece. A movable end of the latch plate is engaged with the slot so that the slide piece alters the tilt angle of the slide piece relative the longitudinal sliding direction of the slide piece, which is parallel with an insertion direction of power pins into the socket power pin receptacles. The pivoting latch plates in the prior art are biased through the slide piece by means of a coil spring towards a more tilted orientation in which the edges dig into the engaged power pin. The coil spring is compressed between a ledge on the slide piece and a fixed feature inside a housing of the connector. As a power pin is inserted, the contact of the power pin with the latch plate causes the latch plate to pivot towards a perpendicular orientation to the insertion direction, thereby further compressing the coil spring and allowing the power pin to enter and pass through the latch plate aperture. Once the power pin is fully inserted, the coil spring biases the latch plate securely towards the tilted orientation so that the aperture edges of the latch plate dig into the power pin when inserted to prevent removal.

In the prior art, the power pin when locked by a power pin locking mechanism may be released by manually activating a release mechanism, which includes a release button on a manually accessible portion of the line plug or panel socket. The release button is slid or pressed to cause a corresponding movement of the slide piece. The release button may be a sliding button that extends transversely away from a main of the slide piece, out through an aperture in a back connector body, as in GB 2383202 A. Alternatively, the button may be a push button that extends parallel with a sliding portion of the slide piece on the panel portion side of the plug insertion channel, as in GB 2463468 A. The release button causes the slide piece to move the latch plate to a more perpendicular orientation relative to the plug insertion direction which increases the separation of the latch plate aperture edges in the transverse direction, thereby releasing the grip of the latch plate apertures edges from the inserted slide pin after, which the plug may be disengaged from the locking socket.

Whilst this arrangement works well in practice, it is difficult to devise automatic production equipment that will assemble all the internal components of the locking socket, and it is particularly difficult to devise a production machine that will reliably manipulate and assemble the coil spring with the other components within the socket, particularly the slide piece. Production of such locking sockets is therefore not fully automatic and requires at least some manual assembly, which adds to the cost of the finished product.

It is an object of the present invention to provide an improved locking power connector apparatus that addresses these issues.

SUMMARY OF THE INVENTION

According to the invention there is provided a locking power connector apparatus, comprising a locking socket for making an electrical connection with an electrical plug, the locking socket comprising:

a) a socket connection portion, the socket connection portion having an end face and the end face having a plurality of recesses for receiving corresponding power pins of said plug along a longitudinal direction when said plug is plugged into said socket connection portion;

b) a power pin locking mechanism within the socket connection portion for restraining said plug from being unplugged from said socket connection portion, said locking mechanism comprising a pivoting latch plate that is pivotable between a first orientation and a second orientation, a slide piece that is slideable in oppositely directed first and second directions, the slide piece being biased by a biasing force that urges the slide piece in the second direction, the latch plate having an aperture therethrough, the aperture having edges that allow one of said power pins to pass through the aperture either to be inserted into or to be withdrawn from the corresponding recess when the latch plate is in the first orientation and that engage with said inserted power pin when the latch plate is in the second orientation, thus restraining said plug from being unplugged, the slide piece being engaged with a movable end of the latch plate whereby the slide piece slides along the first direction when the latch plate pivots from the second orientation to the first orientation and slides along the second direction when the latch plate pivots from the first orientation to the second orientation;

c) a release mechanism for releasing said locking mechanism to permit said plug to be unplugged from said socket connection portion, the release mechanism comprising a button that is manually activateable to a user of the locking power connector apparatus, the release mechanism being engaged with the slide piece such that the release mechanism causes the slide piece to slide along the first direction and pivot the latch plate from the second orientation to the first orientation to release said inserted power pin when the button is manually activated;

wherein the slide piece comprises a main body and at least one arm that is an extension of said main body in a lateral direction that is transverse to the longitudinal direction, said at least one arm being resiliently flexible in the longitudinal direction and having a distal portion that is restrained in the longitudinal direction by a restraining feature of the locking socket, whereby said at least one arm is progressively flexed by movement of said main body relative to the restraining feature as the slide piece slides in the first direction, said flexing of said at least one arm thereby providing said biasing force that urges the slide piece in the second direction.

The power pin may be any type of pin, for example a live pin, a neutral pin or a ground pin.

Preferably, the slide piece that is slideable along a guide within the socket connection portion in the oppositely directed first and second directions.

When the aperture edges of the pivoting latch plate dig in to the power pin when this is pulled in the opposite direction, the power pin, and hence the rest of the line plug, are locked to the panel socket. A user may then unlock the line plug by pressing or sliding the release button.

In preferred embodiments of the invention, the first and second directions along which the slide piece slides are substantially parallel with the longitudinal direction.

In preferred embodiments of the invention, the slide piece is a one-piece component, that is, a component not composed of different sub-components. The slide piece therefore has no joints, joins or seams. The slide piece will most conveniently be formed in a plastics material, for example by injection moulding.

The, or each, arm may have a proximal portion nearest the slide piece main body and a medial portion between the proximal portion and the distal portion. The thickness of the medial portion in the longitudinal direction preferably tapers towards the distal portion.

Preferably, the medial portion of the arm extends away from the slide piece in a direction that is substantially perpendicular to the longitudinal direction.

In one preferred embodiment of the invention, the flexing of the, or each, arm is not fully relaxed as the slide piece slides fully in the second direction. This is so that the biasing force does not decline to zero as the slide piece slides fully in the second direction. In other words, the biasing force urges the slide piece fully in the second direction.

The slide piece may comprise a longitudinally extending slide shaft, the slide shaft having a first end and a second end. The latch plate is then engaged with the slide piece proximate the second end of the slide shaft, with the arm extending in a transverse direction proximate the first end of the slide shaft.

The locking socket may be a locking line socket for making an electrical connection with an electrical panel plug. In this case, the locking line socket comprises a main body having a front connector body for insertion into a main recess of a panel plug and a rear connector body, the release button being manually accessible on rear connector body when the line socket is plugged into the panel plug.

Alternatively, the locking socket may be a locking panel socket for making an electrical connection with an electrical line plug. The locking power connector apparatus then further comprises a plug insertion channel, the plug insertion channel extending around the socket connection portion for receiving a skirt of the line plug when the line plug is plugged into the socket connection portion. The locking power connector apparatus then further comprises a panel portion, the panel portion defining a plane and extending around the plug insertion channel, the button being manually accessible on the panel portion when the line plug is plugged into the socket connection portion.

In a preferred embodiment of the invention, the button stands proud of the panel portion when the latch plate is engaged with the power pin and is substantially flush with the panel portion when the latch plate is disengaged with a power pin.

The slide piece may comprise a longitudinally extending slide shaft and a transversely extending portion that spans the distance between the socket connection portion and the panel portion. The slide shaft then extends away from the latch plate in the first direction and towards the transverse portion. The button may be a push button linked to the transverse portion whereby the button, when pressed, causes the transverse portion to move and carry the slide shaft in the first direction.

In this case, the transversely extending portion therefore extends beneath the base of the plug insertion channel.

The button may be linked to the transverse portion by a rod. In this case, the transverse portion is moved by the rod in the same direction as the button when the button is manually pushed.

The rod and the slide piece need not be of a unitary construction, but may be composed of separate pieces. The use of separate components is particularly beneficial if the resiliently flexible arm or arms impart a twisting moment to the transverse portion of the slide piece main body, as the rod is then not affected by any such twisting. However, if the biasing force is sufficiently balanced such there is no or little twisting, then it is preferred if the rod is unitary with the slide piece.

The rod may extend away from the push button into an interior portion of the panel portion of the locking panel socket. An end portion of the rod may then be configured to push the slide piece in the first direction to disconnect the line plug. Because the push button is beyond an outer periphery of the plug insertion channel and the latch plate is within an inner periphery of the plug insertion channel, the release mechanism and the slide piece are linked together beneath a base of the plug insertion channel by a transverse section or portion that extends between substantially longitudinally extending portions on opposite sides of the plug insertion channel. The substantially longitudinally extending portions preferably extend perpendicularly to the plane of the panel portion, which will in general be the same as a plane of the socket connection portion. The transverse portion may be a portion of the slide piece, in which case the rod may be a separate component from the slide piece. Alternatively, the transverse portion may be a lateral extension of the rod and a separate component from the slide piece. In one preferred embodiment of the invention, the transverse portion is a part of the slide piece and the rod is of one piece with the slide piece, such that the rod extends away from the transverse portion towards the release button.

The, or each, arm may extend from the transversely extending portion of the slide piece in a lateral direction that is transverse to the longitudinal direction.

The, or each, arm may extend substantially perpendicularly from a span of the transversely extending portion between the socket connection portion and the panel portion. The arm may then extend substantially perpendicularly from a mid-point of this span of the transversely extending portion.

There may be two arms, which extend in opposite directions from opposite lateral sides of the transversely extending portion. In this case, the directions in which the arms extend from the transversely extending portion are substantially at right angles to a direction in which the latch plate extends from the slide piece when the latch plate is tilted to be substantially perpendicular to the longitudinal direction. The benefit of this arrangement is that this allows twisting forces on the slide piece to be minimised, particularly twisting forces that could impart a rotation to the latch plate a long axis of the latch plate aperture.

Alternatively, there may be just one arm, which extends from one lateral side of the transversely extending portion. The direction in which this single arm extends from the transversely extending portion is preferably parallel to a direction in which the latch plate extends from the slide piece when the latch plate is tilted to be substantially perpendicular to the longitudinal direction.

The locking power connector apparatus may further comprise an electrical plug having a plurality of power pins. The recesses in the end face the socket connection portion, in use, each receive along the longitudinal direction a corresponding one of the power pins when the plug is plugged into the socket connection portion. One of the power pins is configured to pass through the aperture of the latch plate when being inserted into the corresponding recess and is configured to be engaged by the edges in the aperture of the latch plate to restrain the plug from being unplugged from the socket connection portion until released from the aperture by the release mechanism.

The rod may extend away from the push button into an interior portion of the panel portion of the locking panel socket. An end portion of the rod may then be configured to push the slide piece in the first direction to disconnect the line plug. Because the push button is beyond an outer periphery of the plug insertion channel and the latch plate is within an inner periphery of the plug insertion channel, the release mechanism and the slide piece are linked together beneath a base of the plug insertion channel by transverse section or portion that extends between substantially longitudinally extending portions on opposite sides of the plug insertion channel. The substantially longitudinally extending portions preferably extend perpendicularly to the plane of the panel portion, which will in general be the same as a plane of the socket connection portion. The transverse portion may be a portion of the slide piece, in which case the rod may be a separate component from the slide piece. Alternatively, the transverse portion may be a lateral extension of the rod and a separate component from the slide piece. In one preferred embodiment of the invention, the transverse portion is a part of the slide piece and the rod is of one piece with the slide piece, such that the rod extends away from the transverse portion towards the release button.

The invention also provides a locking power connector apparatus, comprising a locking panel socket and a line plug for electrical connection with the locking panel socket, in which the locking panel socket is according to the invention.

BRIEF DESCRIPTION OF THE DRAWINGS

The invention will now be further described, by way of example only, with reference to the accompanying drawings, in which.

DETAILED DESCRIPTION

Figure 1:
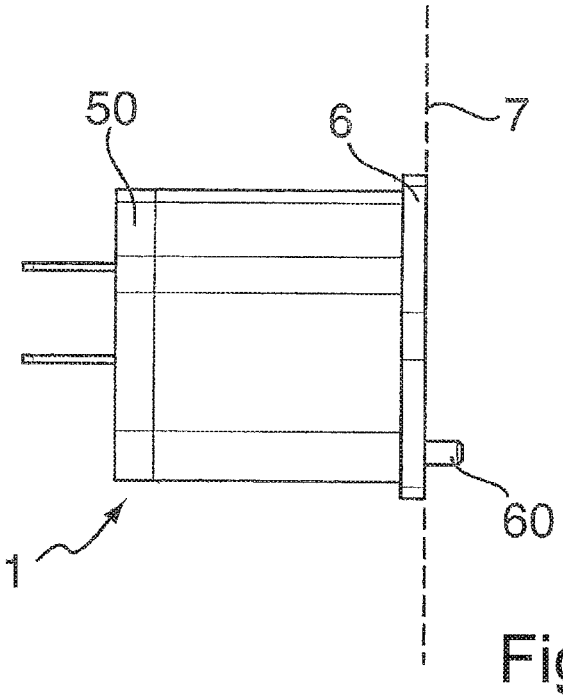
FIGS. 1 and 2 are side and front views of a locking panel socket according to a preferred embodiment of the invention, showing three recesses in a socket connector portion bounded by a plug insertion channel which is itself surrounded by a panel-mounting flange.
Figure 2:
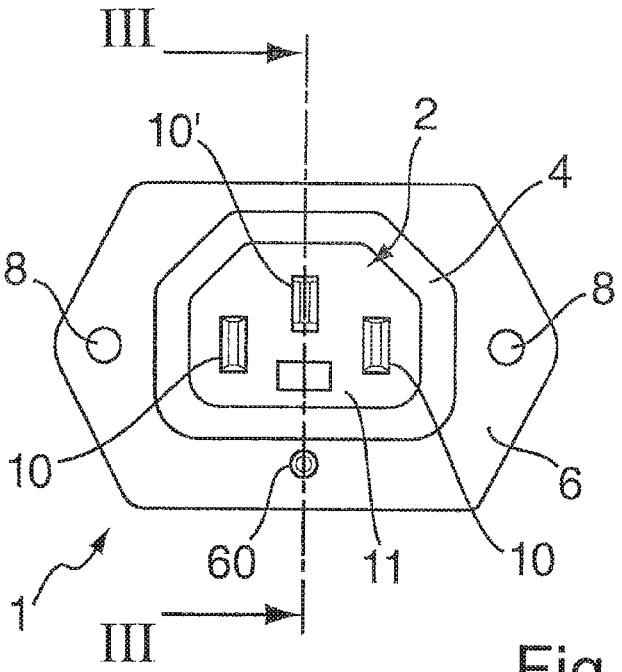

FIGS. 1-4 show various views of a locking panel socket 1, having a socket connection portion 2 that is surrounded by a plug insertion channel 4 which is itself surrounded by a panel portion 6. In the example, the panel socket 1 conforms to the IEC C13 and C14 standards.

The socket connection portion 2, channel 4 and panel portion 6 share a common main housing body 5. The socket connection portion 2 has an end face 11 and the panel portion 6 comprises a panel mounting flange 26 having a pair of holes 8 therein by which the flange 26 may be secured to an item of equipment, for example the chassis of an electronic device or a power distribution strip (not shown). The end face 11 is bounded by the surrounding channel 4.

The socket connection portion 2 has three power pin recesses 10, 10' formed in the end face 11 of the socket connection portion for receiving three corresponding power pins 80 of a line plug 100, also conforming to the IEC standard. In this example, the power pins are blade-like. Such power pins are provided within a protective skirt or shroud of the line plug, as illustrated in phantom outline 90 in FIG. 3B. The end face 11 and surrounding flange 26 are co-planar as indicated by dashed line 7 in FIG. 1.

The channel 4 has a base wall 3, an inner wall 9, and an outer wall 13. The spacing between the channel walls 9, 13 and the depth of the base wall 3 relative to the end face 11 and surrounding flange 26 is such that the channel is sized to receive and securely hold the shroud 90 of a line plug.

The channel walls 3, 9, 13 are all formed in one piece as part of the main housing body 5 and together provide an outer wall of the locking panel socket, this outer wall extending away from the end face 11 and surrounding flange 26. Beneath the channel base wall 3, a rear end 29 of the main housing body 5 is joined to a rear housing cover 50 of the locking panel socket. The rear housing cover 50 may be fixed to the housing main body 5 by any convenient means, for example by screws (not shown) that pass through holes 22 in the rear housing cover into threaded bores (not shown) in the rear end 29 of the main housing body 5. Together, the main housing body 5 and the rear housing cover 50 provide a housing for the components of the locking panel socket to be described below.

One of the recesses 10' includes a locking mechanism 12 comprising a rectangular pivoting metallic latch plate 14 that has a rectangular aperture 40 with opposite short edges 16, 18. The aperture opposite edges 16, 18 are far enough apart to provide free passage to one of the power pins 80, shown in phantom outline in FIG. 3B as being inserted into the recess 10', when a long axis 19 of the aperture 40 and a plane of the aperture extend perpendicularly to an insertion direction 21 of the power pins, but are close enough together such that these edges engage with and dig into opposite short sides of the power pin 80 when the power pin is inserted and the latch plate is pivoted to tilt the aperture long axis 19 away from perpendicular to the insertion direction 21. In the following description, any direction parallel with the insertion direction is referred to as a longitudinal direction and any direction perpendicular or substantially perpendicular to the longitudinal direction is referred to as a transverse direction.

The recesses 10, 10' are symmetrically arranged with respect to a central plane 20 through the locking panel socket 1. In this example, the recess 10' associated with the locking mechanism 12 is bisected by the central plane and is for receiving the power pin to make a around connection. The locking mechanism is therefore never energised. The other two recesses 10, which are for receiving power pins for making live and neutral connections, are transversely offset relative to the centrally located recess 10' and are mirror-symmetric with each other about the central plane 20. The three recesses are therefore triangularly oriented with respect to each other in the end face 11 of the main housing body 5.

The latch plate 14 is also bisected by the central plane 20 and has opposite short sides that extend perpendicularly with through the central plane. One of the short sides is a pivot side 15 and the other of the short sides is a moving side 17. The pivot side 15 is loosely held in a stationary pocket 23 inside the socket connection portion 2. The moving side 17 of the latch plate is loosely held by a gripping feature 32 of a slide piece 28 that is slideable forwards and backwards along a longitudinal direction. In this example, the gripping feature is a notch near an end of the slide shaft, the notch facing towards the plug insertion channel 10'.

The latch plate aperture 40 is offset relative to the centre of the latch plate 14 so that the aperture is nearer the pivot side 15 of the latch plate and further from the moving side 17 of the latch plate. This provides mechanical advantage at the aperture to assist in disengaging the latch plate aperture edges from the power pin as the latch plate is pivoted towards the perpendicular orientation by the gripping feature of the slide piece 28.

Figure 3A:
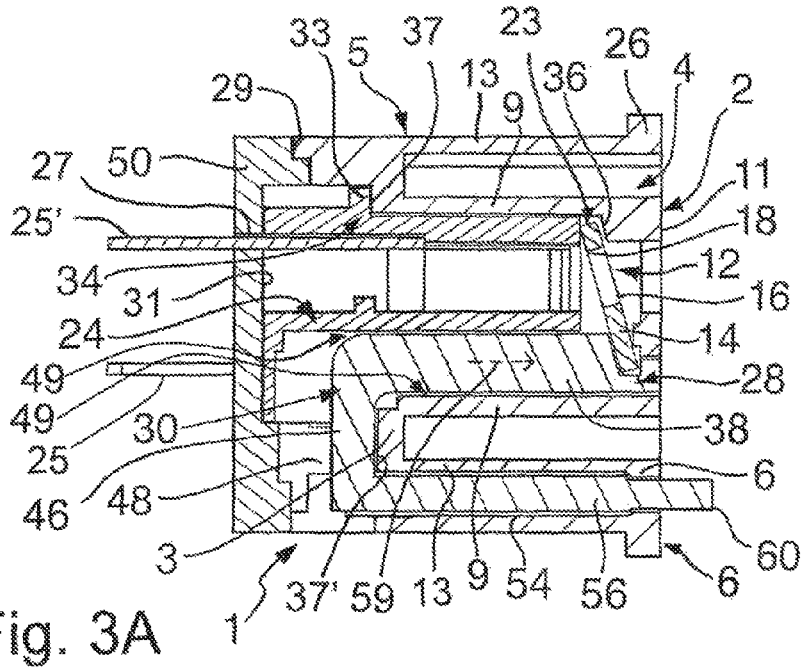
FIGS. 3A and 3B show cross-sections through the panel socket, taken along line III-III of FIG. 2, showing a locking mechanism and release mechanism in, respectively, locked and open states.

The movement of the latch plate by the gripping feature is therefore the same as that disclosed in patent document GB 2 383 202 A. As in the prior art, the pivoting latch plate 14 is biased towards a tilted, locking orientation, as shown in FIG. 3A.

A rod 56 may extend away from a push button 60 into an interior portion of the panel portion 6 of the locking panel socket 1. An inner end portion or base portion 57 of the rod may then be configured to push the slide piece 28 in a first direction 58 when the push button is manually pressed to disconnect the line plug. Because the push button is beyond an outer periphery of the plug insertion channel 4 and because the latch plate 14 is within an inner periphery of the plug insertion channel, the release mechanism and the slide piece are linked together beneath the base wall 3 of the plug insertion channel by a transverse portion 46 that extends between substantially longitudinally extending portions on opposite sides of the plug insertion channel 4. The substantially longitudinally extending portions preferably extend perpendicularly to the plane of the panel portion, which will in general be the same as a plane of the socket connection portion. The transverse portion is a portion of the slide piece, as it slides together with the slide piece; however the rod may be a separate component from the slide piece. Alternatively, the transverse portion may be a lateral extension of the rod and joined or simply maintained in contact with the rest of the slide piece. In one preferred embodiment of the invention, the transverse portion is a part of the slide piece and the rod is of one piece with the slide piece, such that the rod extends away from the transverse portion towards the release button.

Inside the socket connection portion 2 behind the end face 11, are three longitudinally extending blade-type contacts 42, 42' for receiving the power pins 80. Two of the contacts 42 are for live and neutral connections and the third contact 42' is for the ground connection. Each contact extends in a longitudinal direction away from the socket end face 11 to a corresponding connection blade 25, 25' to which connecting wires (not shown) are, in use, connected to make live, neutral and ground connections to the three contacts 42, 42'. Each connection blade 25, 25' longitudinally extends through a slot 27 in the rear housing cover 50. The slots 27 are each closely fitting around the connection blades 25, 25', which has the effect of transversely locating the connection blades relative to the longitudinal direction.

Figure 4:
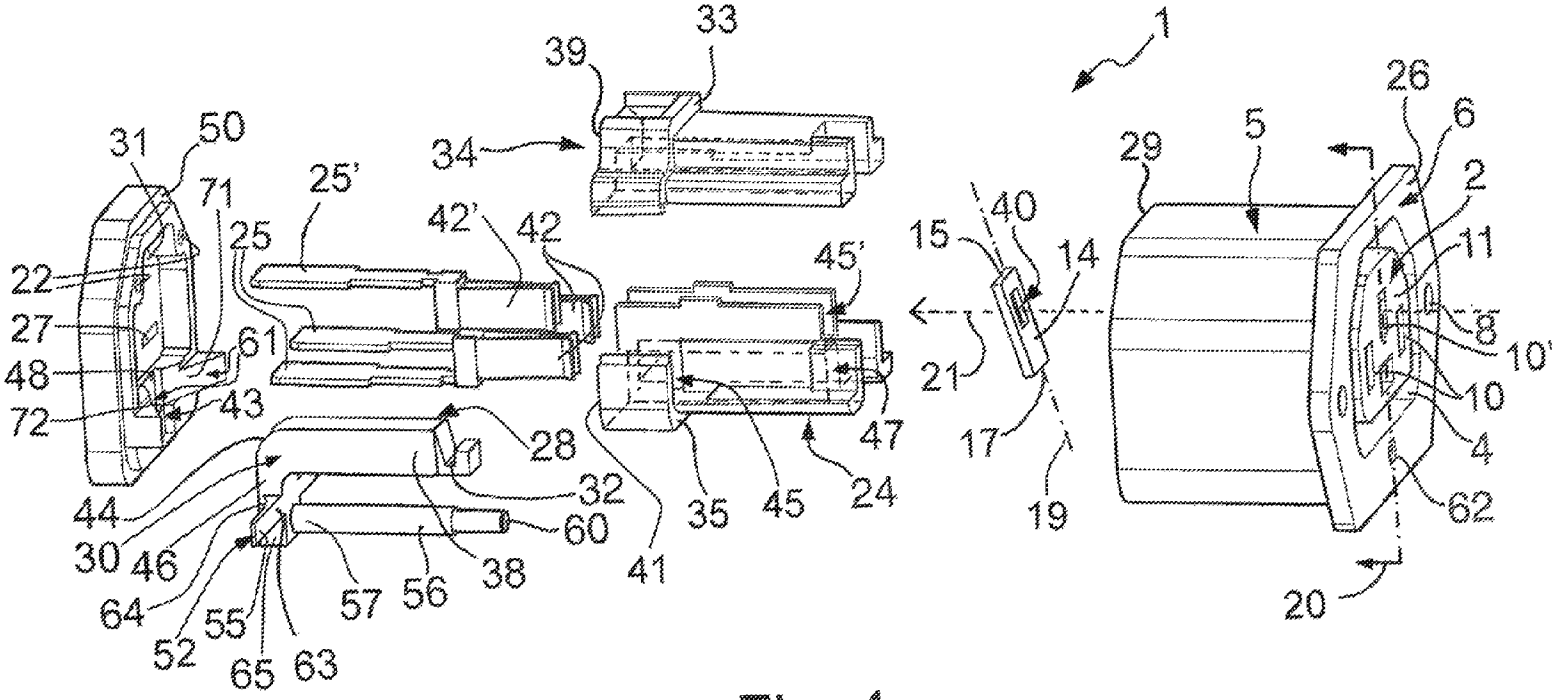
FIG. 4 is an exploded view of the panel socket of FIG. 1.

Inside the socket connection portion 2, are two insert members 24, 34 which insulate, space apart and correctly locate in both longitudinal and transverse directions the three contacts 42, 42', in particular so that these are accurately fixed in place with respect to the three recesses 10, 10'. As illustrated in FIG. 4, the lower one 24 of the insert members receives the three contacts in three corresponding longitudinally extending contact channels, two of which 45, 45' are visible in FIG. 4. An upper contact channel 45' is centered on the central plane 20 of the locking panel socket for receiving the ground contact 42'. The lower insert 24 is mirror symmetric about the central plane 20. The other two contact channels 45 are spaced apart equidistantly from the central plane and are positioned to receive the neutral and live contacts 42.

The channels 45, 45' in the lower insert member 24 are substantially square U-shaped and therefore extend around three sides of the corresponding contact 42, 42'. The upper insert member 34 abuts the lower insert member to cap the three U-shaped channels. The three contacts are therefore secured transversely in place by the insert members 24, 34.

Each insert member has a rearwardly facing end surface 39, 41 which locates against a forwards facing inner surface 31 of the rear housing cover 50. Each insert member 24, 34 has mid-way along its length a forwards facing ledge 33, 35 which locates against a rearwards facing abutment 37 that extends around the inner periphery of the rear end 29 of the main housing body 5, beneath the base wall 3 of the channel 4. In this way, the two insert members 24, 34, and therefore the three contacts 42, 42' are securely held in place inside the socket connection portion 2 along the longitudinal direction.

The lower insert member 24 has midway between the live and neutral contact channels 45 a longitudinally extending channel 47 which provides three sides of a square-cornered slide channel 49 which provides a guide for the slide piece 28. The fourth side of the slide channel 49 is provided by an adjacent inwardly facing surface 51 of the inner wall 9 of the plug insertion channel 4. The slide piece 28 has a main body 30 comprising an elongate slide shaft 38 that extends in a longitudinal direction inside the slide channel 47, and the transverse portion 46 that extends perpendicularly to the slide shaft 38 at its furthest extent from the end face 11. The slide piece also has a rounded elbow 44 at the junction between the slide shaft and the transverse portion of the slide piece.

The slide shaft 38 has a rectangular cross-section which is closely matches the slide channel 49 with sufficient clearance to provide a smooth sliding motion for the slide piece. The end of the slide shaft 38 nearest the end face 11 of the socket connection portion provides the gripping feature 32 that engages with the moving side 17 of the pivoting latch plate 14. The pivot side 15 of the latch plate 14 is held in place but free to pivot with the pocket 23. The pocket is provided between a forwards end surface 53 of the upper insert member 34 and a ledge 36 on adjacent portion of the inner wall 13 of the plug insertion channel 4 within the socket connection portion 2. The transverse section or portion 46 of the slide piece main body 30 extends into a slot 43 in the inner surface 31 of the rear housing cover 50, beneath the base wall 3 of the plug insertion channel 4. The contact of the transverse portion 46 with a base surface 48 of the slot 43 sets the limit of travel of the slide piece 28 in a first direction 58 in which the latch plate is pivoted to a first, straight orientation, as shown in FIG. 3B.

The contact of the transverse portion 46 with a portion 37' of the rearwards facing abutment in the inner periphery of the rear end 29 of the common housing main body 5 of the locking panel socket sets the limit of travel of the slide piece 28 in a second direction 59 in which the latch plate is pivoted to a second, tilted orientation, as shown in FIG. 3A.

Figure 3B:
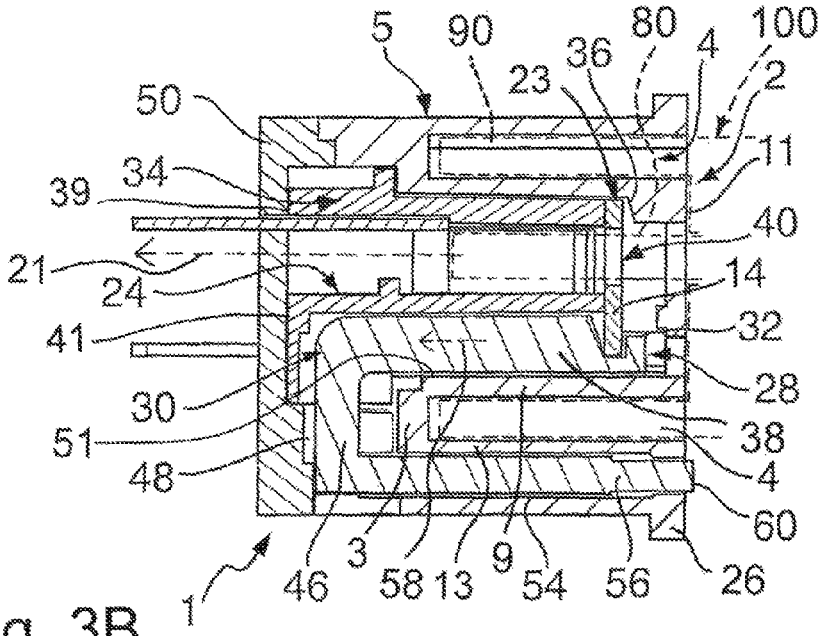

When the slide piece 28 is moved relatively away from the socket end face 11, the pivoting latch plate 14 is moved from the tilted orientation as shown in FIG. 3A to the straight orientation parallel with the end face 11 and perpendicular to the pin insertion direction 21, as shown in FIG. 3B. When the metallic latch plate 14 is titled away from perpendicular to the pin insertion direction, the lower and upper edges 16, 18 in the aperture 40 through the latch plate 14 dig into the power pin 80 when inserted, thereby maintaining electrical contact of all inserted power pins with the three blade-type contacts 42, 42' secured between the lower and upper inserts 24, 34.

In the present invention, the slide piece main body 30 comprises at least one arm that extends laterally away from the main body of the slide piece to provide a biasing force that urges the main body of the slide piece in the second direction 59 in which the latch plate 14 will engage with the power pin 80 when inserted.

In this example, there are two such arms 52, which extend in opposite lateral directions from opposite lateral sides 65 of the transversely extending portion 46. As will be explained below, the arms 52 provide a balanced biasing force that urges the slide piece 28 in the second direction 59 and which reacts against the push button 60 when pushed, in such a way that any twisting tendency of the slide piece is minimised both during insertion and withdrawal of the power pin 80.

The slide piece is made in one-piece from a resiliently flexible plastic material so that the arms 52 are integral with the slide piece main body 30. Because the slide piece is of one-piece, or undivided, construction and includes biasing means in the form of at least one arm to provide the biasing force, machine assembly of the biased locking and release mechanism is greatly simplified as compared with the prior art.

In FIG. 4, it can be seen that the opposite directions in which the arms 52 extend from the transversely extending portion 46 are substantially at right angles to a direction in which the latch plate 14 extends from the slide piece 28 when the latch plate is tilted to be substantially perpendicular to the longitudinal direction 21. The biasing forces are therefore balanced to the left and right of the long axis 19 of the latch plate, and so there is no left or right twisting of the latch plate.

Each arm 52 is an extension of the slide piece main body 30 in a lateral direction that is transverse to the longitudinal direction 21. The arms are each resiliently flexible in the longitudinal direction and have a distal portion 55 that is restrained in the longitudinal direction by a restraining feature 61 of the locking socket, which in this example is provided by two ramp-shaped abutments 71, 72 that extend laterally away on either side of the slot 43 in the rear housing cover 50. As each arm is progressively flexed by sliding movement in the first direction 58 of the slide piece main body 30 inside the guide provided by the slide channel 49 relative to the corresponding restraining feature 61, the flexing of each arm provides the biasing force that urges the slide piece 28 in the second direction 59. This provides the biasing force needed to urge the latch plate 14 towards the tilted, locked orientation.

Each arm 52 has a proximal portion 63 that is thicker in the longitudinal direction that the distal portion 55. This minimises flexing and hence stress concentration near the transversely extending portion 46, thereby reducing the possibility of material fatigue. In particular, the proximal portion of each arm has a concave under-surface 64 that is radiused in a longitudinally extending plane aligned with the length of each arm.

Between the proximal and distal portions is a medial portion 75 of the arm that provides most of flexibility in the longitudinal direction. However, both the proximal portion and the distal portion may have some inherent resilient flexibility, and so may also contribute to the biasing force.

A cylindrical channel 54 extends through the main housing body 5 of the panel socket 1, laterally outside the channel 4, in a direction parallel with the insertion direction 21 of the power pins 80 and perpendicular with the plane 7 defined by the end face 11 and surrounding flange 26. The channel terminates with a hole 62 in the flange 26 of the panel portion, through which the button projects. In this example, the rod 56 is unitary with the slide piece 28. There is therefore no division or join between the base portion 57 of the rod and the transverse portion 46 of the slide piece.

The rod 56 is preferably a stepped cylindrical rod, in which case the channel 54 is stepped to match the shape of the rod. The hole 62 and the rod end providing the button 60 are of reduced diameter as compared with a central portion of the cylindrical rod 56 so that the rod is retained within the main housing body 5 of the panel socket 1.

When the power pin 80 presses into the latch plate aperture 40, or when a user presses the button 60, the slide piece main body 30 is forced in the first direction 58 and the arms 52 are progressively flexed by movement of the slide piece main body relative to the ramp-shaped abutments 71, 72, which therefore provide a restraining feature for the arms. This flexing of the arms then provides the biasing force that urges the slide piece 28 in the second direction 59.

As shown in FIG. 3A, when the locking mechanism is in the locked condition, the transverse portion 46 of the slide piece 28 forces the rod forwards so that the button 60 stands proud of the panel portion 6. This press button 60 serves as an actuation portion of a release mechanism which, when depressed, moves the rod 56 and slide piece 28 to rotate the latch plate 14 to the straight orientation as shown in FIG. 3B. A user can therefore easily disengage the locked line plug 100 from the locking panel socket 1 by pushing on the exposed rod end portion 60 to disengage the locked line plug.

Figure 5:
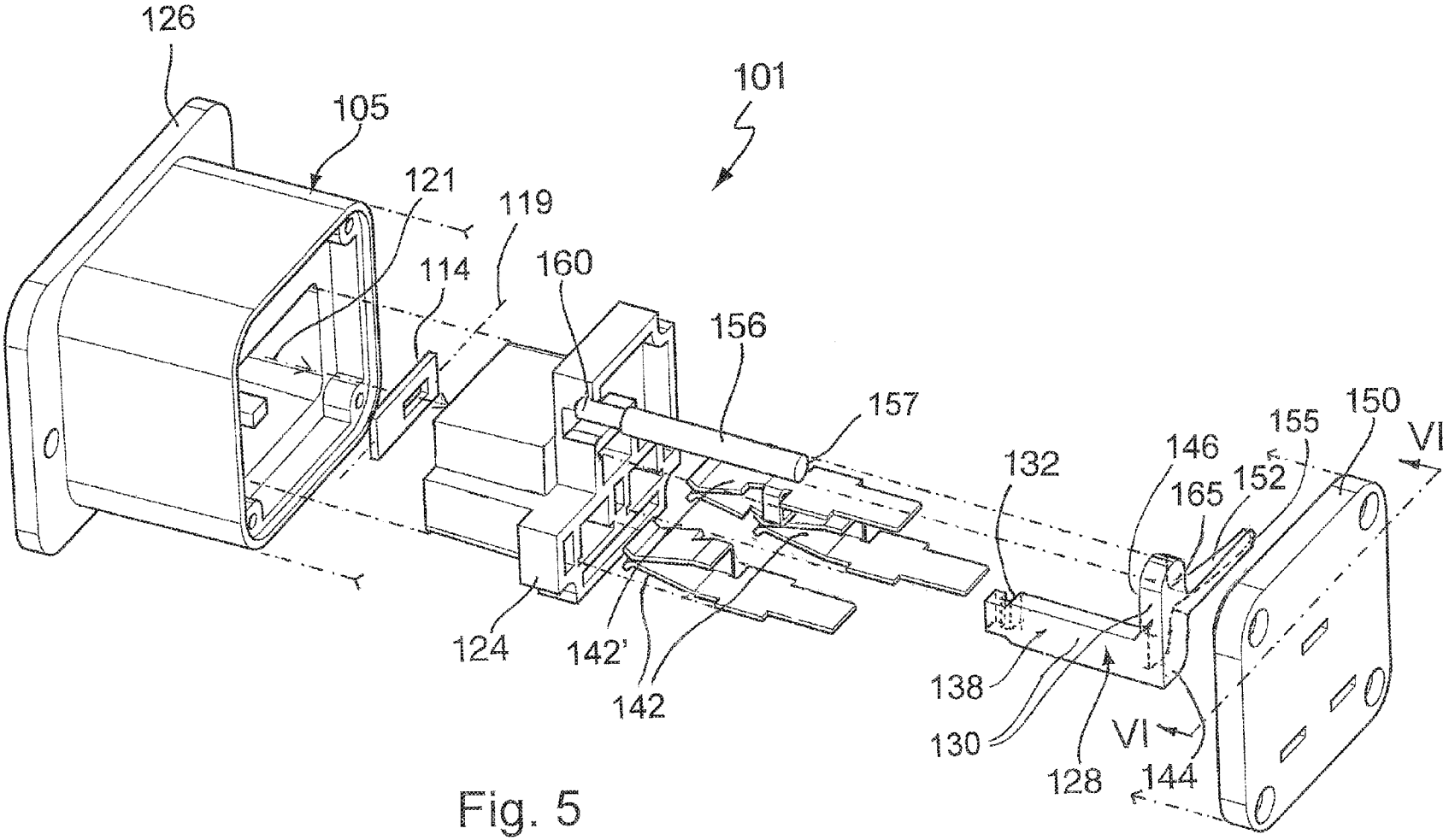
FIG. 5 is an exploded view of a locking panel socket according to a second embodiment of the invention.
Figure 6:
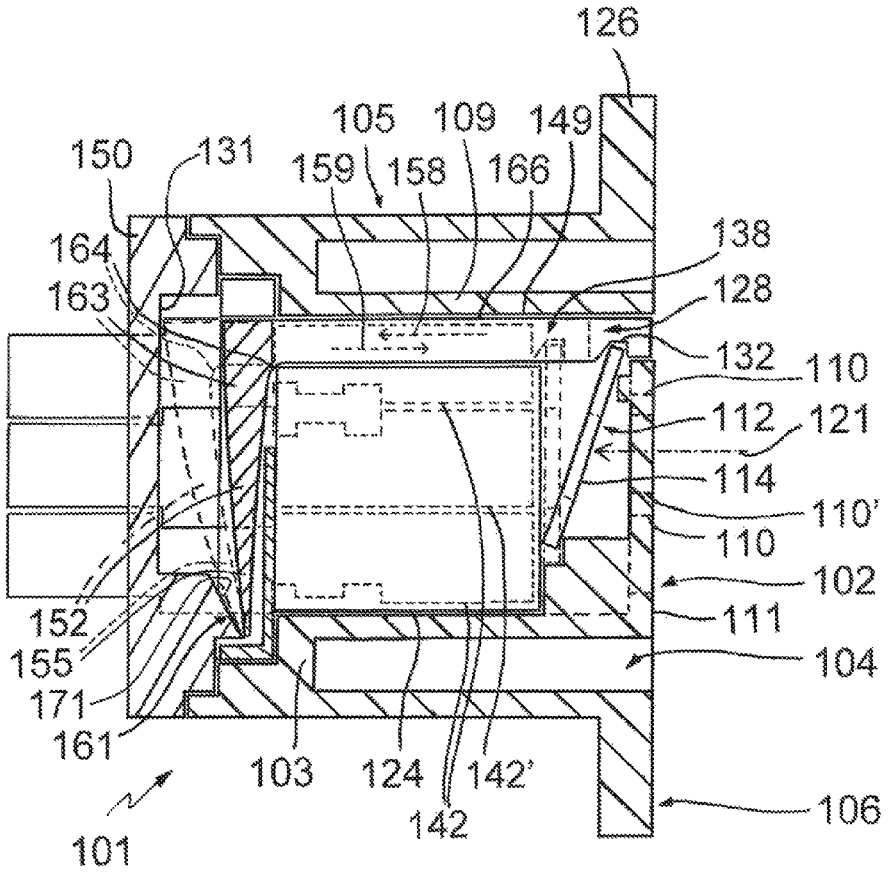
FIG. 6 is a cross-section of the locking panel socket of FIG. 5, taken along line VI-VI of FIG. 5.

FIGS. 5 and 6 show a second embodiment of the invention, in which features corresponding with those of FIGS. 1-4 are indicated by reference numerals incremented by 100. The second embodiment of locking panel socket 101 is of the same general form as that of the first embodiment, having a socket connection portion 102 that is surrounded by a plug insertion channel 104 which is itself surrounded by a panel portion 106.

The socket connection portion 102, channel 104 and panel portion 106 share a common main housing body 105. The socket connection portion 102 has an end face 111 and the panel portion 106 comprises a panel mounting flange 126. The end face 111 is bounded by the surrounding channel 104.

The socket connection portion 102 has three power pin recesses 110, 110' formed in the end face 111 of the socket connection portion for receiving three corresponding power pins of a line plug (not shown), the power pins being protected within a protective skirt or shroud that inserts into the channel 104.

The main housing body 105 is joined to a rear housing cover 150 and together, the main housing body 105 and the rear housing cover 150 provide a housing for the components of the locking panel socket to be described below.

One of the recesses 110' includes a locking mechanism 112 comprising a rectangular pivoting metallic latch plate 114 and a biased slide piece 128. The form and operation of the latch plate are the same as in the first embodiment, and so will not be described again.

One way in which the locking panel socket 101 shown in FIG. 5 differs from that of the first embodiment is that the slide piece 128 has a main body 130 with a transverse portion 146 that extends from an elbow 144 in a direction that is at right angles to the length of the latch plate 114, rather than in a direction that is substantially parallel with that of the latch plate. The lateral offset in the transverse portion permits a similar lateral offset in a button of the release mechanism relative to a long axis 119 of the latch plate. As in the first embodiment, the release mechanism comprises a stepped cylindrical rod 156 and press button 160. The effect conferred by the transverse portion 146 is, however, the same as that in the first embodiment when this is engaged with the cylindrical rod 156, which is here a separate component from the slide piece 128.

When the protruding end portion 160 of the rod 156 is pressed, an inner end or base end 157 of the rod engages with the transverse portion 146 to move the slide piece 128 longitudinally inwards in a first direction 158 to rotate the latch plate 114 to a straight orientation in which the power pin (not shown) is disengaged from a gripping feature 132 at the end of the slide piece 128 so that the line plug can be withdrawn from three blade-type contacts 142, 142' within the locking panel socket 101. The arrangement as shown in FIG. 5 uses a single insert member 124 to locate the contacts, rather than the split lower and upper insert members 24, 34 of the first embodiment, which can simplify the assembly of the locking panel socket 101.

The slide piece main body 130 comprises a single arm 152 that extends laterally away from the main body of the slide piece to provide a biasing force that urges the main body of the slide piece in the second direction 159 in which the latch plate 114 will engage with the power pin when inserted.

In this example, there is one arm 152 that extends in one lateral direction from one lateral side 165 of the transversely extending portion 146. The arm 152 provides a biasing force that urges the slide piece in a second direction 159 and which reacts against the push button 160 when pushed. Because there is one offset arm, a slide shaft 138 of the main body 130 of the slide piece will experience some twisting moment, or torque, from the arm as this becomes flexibly bent, and this moment is directed generally away from the latch plate. The second embodiment makes advantage of this moment, by using it to accurately locate the gripping feature 132 in the transverse direction. This location is achieved by providing the slide shaft 138 with a rectangular cross-section having a long axis perpendicular to the latch plate long axis 119. The slide shaft then slides on a relatively broad sliding face 166 of the slide shaft on an opposite side the slide piece from the single arm 152. This is done to minimise sliding friction stemming from the twisting moment between this face 166 and an opposite sliding surface 149 on a housing inner wall, which in this example is the wall 109 of the plug insertion channel 104, as well as to accurately locate the gripping feature 132 in the transverse direction along the latch plate long axis 119. The sliding surface 149 therefore provides a sliding guide for the slide piece 128.

The slide piece 128 is made in one-piece from a resiliently flexible plastic material so that the arm 152 is integral with the slide piece main body 130. Because the slide piece is of one-piece, or undivided, construction, and includes biasing means in the form of the arm to provide the biasing force, machine assembly of the biased locking and release mechanism is greatly simplified as compared with the prior art.

In FIGS. 5 and 6, it can be seen that direction in which the arm 152 extends from the transversely extending portion 146 is substantially parallel to a direction in which the latch plate 114 extends from the slide piece 128 when the latch plate is tilted to be substantially perpendicular to the longitudinal direction 121 in which the power pins are inserted.

The arm 152 is an extension of the slide piece main body 130 in a lateral direction that is transverse to the longitudinal direction 121. The arm is resiliently flexible in the longitudinal direction and has a distal portion 155 that is restrained in the longitudinal direction by a restraining feature 161 of the locking socket, which in this example is a ramp-shaped abutment 171 on a forwards facing inner surface 131 of the rear housing cover 150. The ramp-shaped abutment 171 extends laterally upwards and away from a central portion of the rear housing cover 150. The thickness of the arm 152 tapers towards the distal portion 155. As the arm is progressively flexed by sliding movement the first direction 158 of the slide piece main body 130 relative to the ramp-shaped abutment 171, the flexing of the arm provides the biasing force that urges the slide piece 128 in the second direction 159. This provides the biasing force needed to urge the latch plate 114 towards the tilted, locked orientation.

The arm 152 has a proximal portion 163 that is thicker in the longitudinal direction that the distal portion 155. This minimises flexing and hence stress concentration near the transversely extending portion, thereby reducing the possibility of material fatigue. In particular, the proximal portion of each arm has a concave upper surface 164 that is radiused in a longitudinally extending plane aligned with the length of each arm.

Between the proximal and distal portions is a medial portion 175 of the arm that provides most of flexibility in the longitudinal direction. However, both the proximal portion and the distal portion may have some inherent resilient flexibility, and so may also contribute to the biasing force.

In both of the embodiments described above, the slide piece 28, 128 when slid in the first direction 58, 158, causes flexure in at least one arm 52, 152 that extends in a substantially transverse direction away from a laterally extending portion of the slide piece which is at an opposite end of the slide portion 38, 138 from a latch plate engagement end of the slide portion.

As each arm is progressively bent the latch plate is progressively biased towards the tilted, latched orientation. The biased slide pieces 28, 128 are unitary, one-piece components with no material joints, and are well-suited to machine assembly. The invention therefore provides a convenient locking power connector apparatus that is well adapted for automated manufacture.

As the skilled person will appreciate, although the invention has been described above with reference to an IEC connector, the invention is applicable to other types of electrical power connector not necessarily conforming to the IEC connector standards. Furthermore, although the illustrated examples relate to locking panel sockets for making an electrical connection with electrical line plugs, the invention is also applicable to locking line sockets for making an electrical connection with electrical panel plugs.

It is to be recognized that various alterations, modifications, and/or additions may be introduced into the constructions and arrangements of parts described above without departing from the spirit or scope of the present invention, as defined by the appended claims.

What is claimed is:

1. A locking power connector apparatus, comprising a locking socket for making an electrical connection with an electrical plug, the locking socket comprising:

a socket connection portion, the socket connection portion having an end face and the end face having a plurality of recesses for receiving corresponding power pins of said plug along a longitudinal direction when said plug is plugged into said socket connection portion;

a power pin locking mechanism within the socket connection portion for restraining said plug from being unplugged from said socket connection portion, said locking mechanism comprising a pivoting latch plate that is pivotable between a first orientation and a second orientation, a slide piece that is slideable in oppositely directed first and second directions, the slide piece being biased by a biasing force that urges the slide piece in the second direction, the latch plate having an aperture therethrough, the aperture having edges that allow one of said power pins to pass through the aperture either to be inserted into or to be withdrawn from the corresponding recess when the latch plate is in the first orientation and that engage with said inserted power pin when the latch plate is in the second orientation, thus restraining said plug from being unplugged, the slide piece being engaged with a movable end of the latch plate whereby the slide piece slides along the first direction when the latch plate pivots from the second orientation to the first orientation and slides along the second direction when the latch plate pivots from the first orientation to the second orientation;

a release mechanism for releasing said locking mechanism to permit said plug to be unplugged from said socket connection portion, the release mechanism comprising a button that is manually activateable to a user of the locking power connector apparatus, the release mechanism being engaged with the slide piece such that the release mechanism causes the slide piece to slide along the first direction and pivot the latch plate from the second orientation to the first orientation to release said inserted power pin when the button is manually activated;

wherein the slide piece comprises a main body and at least one arm that is an extension of said main body in a lateral direction that is transverse to the longitudinal direction, said at least one arm being resiliently flexible in the longitudinal direction and having a distal portion that is restrained in the longitudinal direction by a restraining feature of the locking socket, whereby said at least one arm is progressively flexed by movement of said main body relative to the restraining feature as the slide piece slides in the first direction, said flexing of said at least one arm thereby providing said biasing force that urges the slide piece in the second direction.

2. The locking power connector apparatus as claimed in claim 1, in which said at least one arm has a proximal portion nearest said main body and a medial portion between the proximal portion and the distal portion, the medial portion having a thickness in said longitudinal direction that tapers towards the distal portion.

3. The locking power connector apparatus as claimed in claim 1, in which said flexing of said at least one arm is not fully relaxed as the slide piece slides fully in the second direction, whereby said biasing force does not decline to zero as the slide piece slides fully in the second direction.

4. The locking power connector apparatus as claimed in claim 2, in which said flexing of said at least one arm is not fully relaxed as the slide piece slides fully in the second direction, whereby said biasing force does not decline to zero as the slide piece slides fully in the second direction.

5. The locking power connector apparatus as claimed in claim 1, in which the slide piece comprises a longitudinally extending slide shaft, the slide shaft having a first end and a second end, the latch plate being engaged with the slide piece proximate the second end of the slide shaft and said at least one arm extending in a transverse direction proximate the first end of the slide shaft.

6. The locking power connector apparatus as claimed in claim 1, in which the locking socket is a locking line socket for making an electrical connection with an electrical panel plug, the locking line socket comprising:

a main body having a front connector body and a rear connector body, the release button being manually accessible on rear connector body when the line socket is plugged into said panel plug.

7. The locking power connector apparatus as claimed in claim 1, in which the locking socket is a locking panel socket for making an electrical connection with an electrical line plug, the locking power connector apparatus further comprising:

a plug insertion channel, the plug insertion channel extending around the socket connection portion for receiving a skirt of said line plug when said line plug is plugged into said socket connection portion; and a panel portion, the panel portion defining a plane and extending around the plug insertion channel, the button being manually accessible on the panel portion when said line plug is plugged into said socket connection portion.

8. The locking power connector apparatus as claimed in claim 7, in which the slide piece comprises a longitudinally extending slide shaft and a transversely extending portion that spans a distance between the socket connection portion and the panel portion, the slide shaft extending away from the latch plate in the first direction and towards the transverse portion, the button being a push button linked to the transverse portion whereby the button when pressed causes the transverse portion to move and carry the slide shaft in the first direction.

9. The locking power connector apparatus as claimed in claim 8, in which in the button is linked to the transverse portion by a rod, whereby the transverse portion is moved by the rod in the same direction as the button when the button is manually pushed.

10. The locking power connector apparatus as claimed in claim 8, in which said at least one arm extends from the transversely extending portion of the slide piece in said lateral direction that is transverse to said longitudinal direction.

11. The locking power connector apparatus as claimed in claim 9, in which said at least one arm extends from the transversely extending portion of the slide piece in said lateral direction that is transverse to said longitudinal direction.

12. The locking power connector apparatus as claimed in claim 10, in which said at least one arm extends substantially perpendicularly from a span of the transversely extending portion between the socket connection portion and the panel portion.

13. The locking power connector apparatus as claimed in claim 11, in which said at least one arm extends substantially perpendicularly from a span of the transversely extending portion between the socket connection portion and the panel portion.

14. The locking power connector apparatus as claimed in claim 12, in which said at least one arm extends substantially perpendicularly from a mid-point of said span of the transversely extending portion.

15. The locking power connector apparatus as claimed in claim 13, in which said at least one arm extends substantially perpendicularly from a mid-point of said span of the transversely extending portion.

16. The locking power connector apparatus as claimed in claim 10, in which there are two arms which extend in opposite directions from opposite lateral sides of the transversely extending portion.

17. The locking power connector apparatus as claimed in claim 16, in which the directions in which said arms extend from the transversely extending portion are substantially at right angles to a direction in which the latch plate extends from the slide piece when the latch plate is tilted to be substantially perpendicular to the longitudinal direction.

18. The locking power connector apparatus as claimed in claim 10, in which there is one arm which extends from one lateral side of the transversely extending portion.

19. The locking power connector apparatus as claimed in claim 18, in which the direction in which said arm extends from the transversely extending portion is parallel to a direction in which the latch plate extends from the slide piece when the latch plate is tilted to be substantially perpendicular to the longitudinal direction.

20. The locking power connector apparatus as claimed in any preceding claim, further comprising an electrical plug having a plurality of power pins, said recesses in the end face the socket connection portion, in use, each receiving along said longitudinal direction a corresponding one of said power pins when said plug is plugged into said socket connection portion, one of said power pins being configured to pass through said aperture of the latch plate when being inserted into the corresponding recess and being configured to be engaged by said edges in the aperture of the latch plate to restraining said plug from being unplugged from said socket connection portion until released from said aperture by said release mechanism.

* * * * *